United States Patent [19]

Fisher et al.

[11] 4,323,025

[45] Apr. 6, 1982

[54] TORPEDO STEERING CONTROL SYSTEM

[75] Inventors: Seth G. Fisher; Stephen Kowalyshyn, both of Ellicott City, Md.

[73] Assignee: The United States of America as represented by the Secretary of the Navy, Washington, D.C.

[21] Appl. No.: 94,095

[22] Filed: Mar. 7, 1961

[51] Int. Cl.[3] ..... F42B 19/04

[52] U.S. Cl. ..... 114/25; 114/23

[58] Field of Search ..... 114/23, 25, 21.1, 21 W, 114/20, 24

[56] References Cited

U.S. PATENT DOCUMENTS

| | | | |
|---|---|---|---|
| 2,980,048 | 4/1961 | Jones et al. | 114/25 |
| 2,996,027 | 8/1961 | Cooke | 114/25 |
| 2,997,971 | 8/1961 | Dickieson | 114/23 |
| 2,997,972 | 8/1961 | Abrams | 114/25 |
| 3,015,297 | 1/1962 | Supernau | 1145/23 |
| 3,054,371 | 9/1962 | Lynch | 114/25 |
| 3,064,609 | 11/1962 | Cooke et al. | 114/23 |

*Primary Examiner*—David H. Brown

*Attorney, Agent, or Firm*—R. S. Sciascia; E. F. Johnston; V. C. Muller

EXEMPLARY CLAIM

1. In a homing torpedo, in combination: means for providing a target search phase of torpedo operation wherein said torpedo is controlled to change depth between predetermined search floor and search ceiling depths and simultaneously controlled to circle in azimuth, whereby to execute helical search action; means for switching, in response to target acquisition at any time during a search phase of torpedo operation, to a target pursuit phase of torpedo operation; and means for switching, in the event of and in response to target loss continuing for a predetermined period in a target pursuit phase, to a modified search phase of torpedo operation wherein said torpedo is initially controlled to execute circle search action while maintaining depth position at substantially that at which target loss occurred, for a predetermined period accommodating at least a complete azimuth circling turn, then controlled to revert to helical search action.

2 Claims, 2 Drawing Figures

TORPEDO STEERING CONTROL SYSTEM

Figure 1:
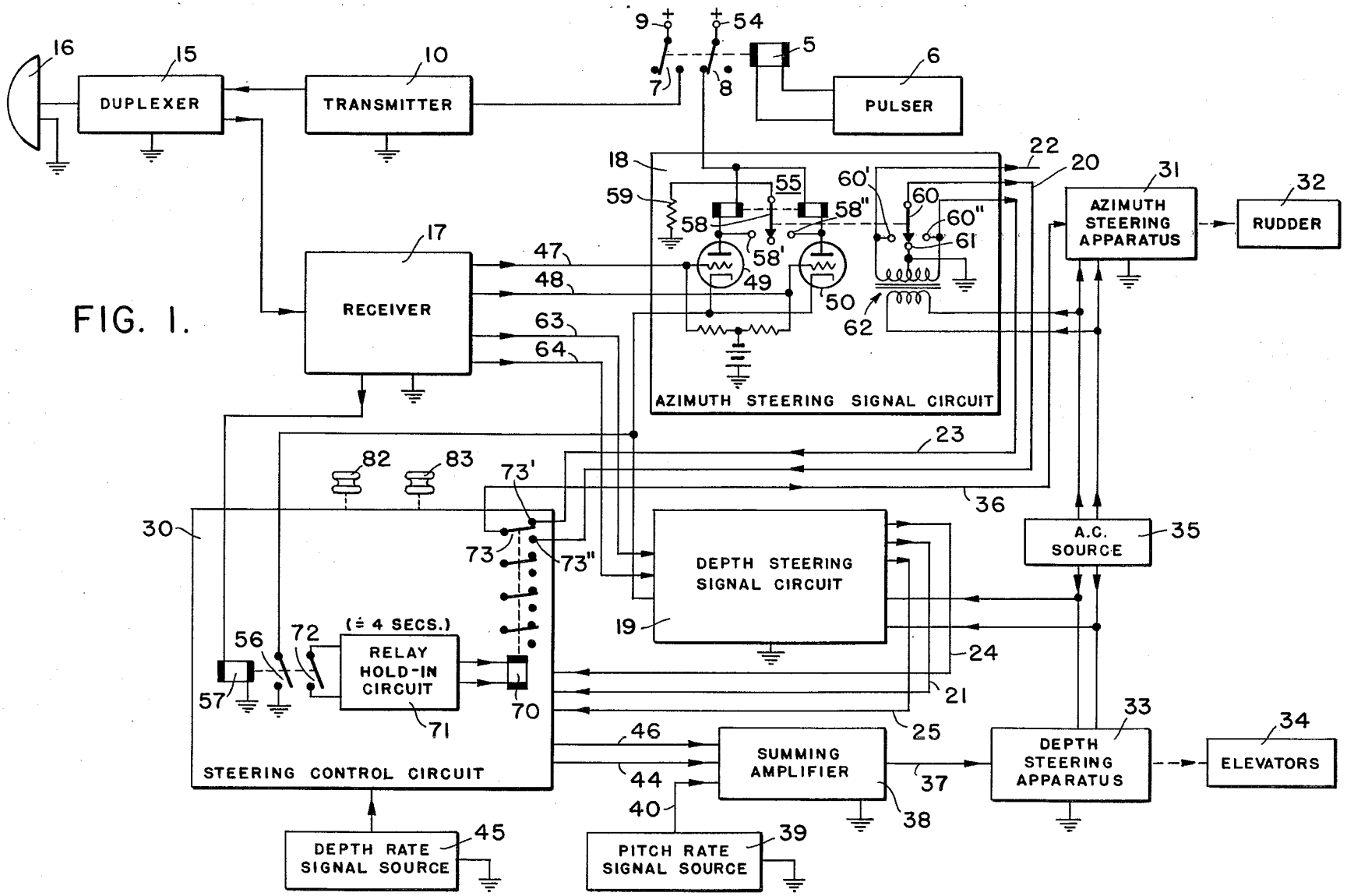

The present invention relates to torpedoes, and more particularly to automatic steering systems for homing torpedoes.

The invention is directly intended for use in anti-submarine acoustic-homing torpedoes of the type designed to operate in a target search phase, effect switchover to a target pursuit (homing) phase upon target detection, and, in the event of ensuing target loss, renew target search and pursuit. Target sensing and target pursuit and attack capabilities in these torpedoes may be provided by use of echo-ranging apparatus which generates and projects sonic or ultrasonic energy, detects resultant echoes, and from these echoes derives the necessary target-direction information. During a target search phase, the torpedo steering apparatus is controlled to effect a sweeping search, in accordance with some predetermined pattern, of an underwater region suspected of encompassing a target submarine. Upon target detection, the torpedo enters a target pursuit phase wherein the torpedo steering is automatically controlled in accordance with the derived target direction information to effect target pursuit and attack action.

The invention concerns an improved system for renewing target search action of the torpedo in the event of target echo loss during a pursuit phase, in particular a search action of unique type which yields high probability of target re-acquisition. Specifically, this system first effects circling of the torpedo in target search condition for a predetermined period at substantially the torpedo depth at which target echo loss occurred, an action here termed flat circle search, then effects helical search action in which the torpedo sweeps or scans a volume extending between predetermined search ceiling and search floor depths. Further, in accordance with the present invention, there is provided a depth steering apparatus for stably maintaining the torpedo at substantially constant depth, as during flat circle search, wherein the depth steering apparatus is controlled by both depth rate and pitch rate sensors.

Accordingly, a principal object of the present invention is to provide an improved homing torpedo steering system yielding high probability of target re-acquisition in the event of target loss during a pursuit phase.

Another object is to provide an improved homing torpedo system which, upon target loss, effects flat circle search action, followed by helical search action in the event of target non-acquisition during the flat circle search action.

It is also an object of the invention to provide an improved torpedo depth control system.

A further object is to provide an improved constant depth steering system wherein depth rate and pitch rate are the sensed variables employed in combination to yield stabilized torpedo depth control.

Figure 2:
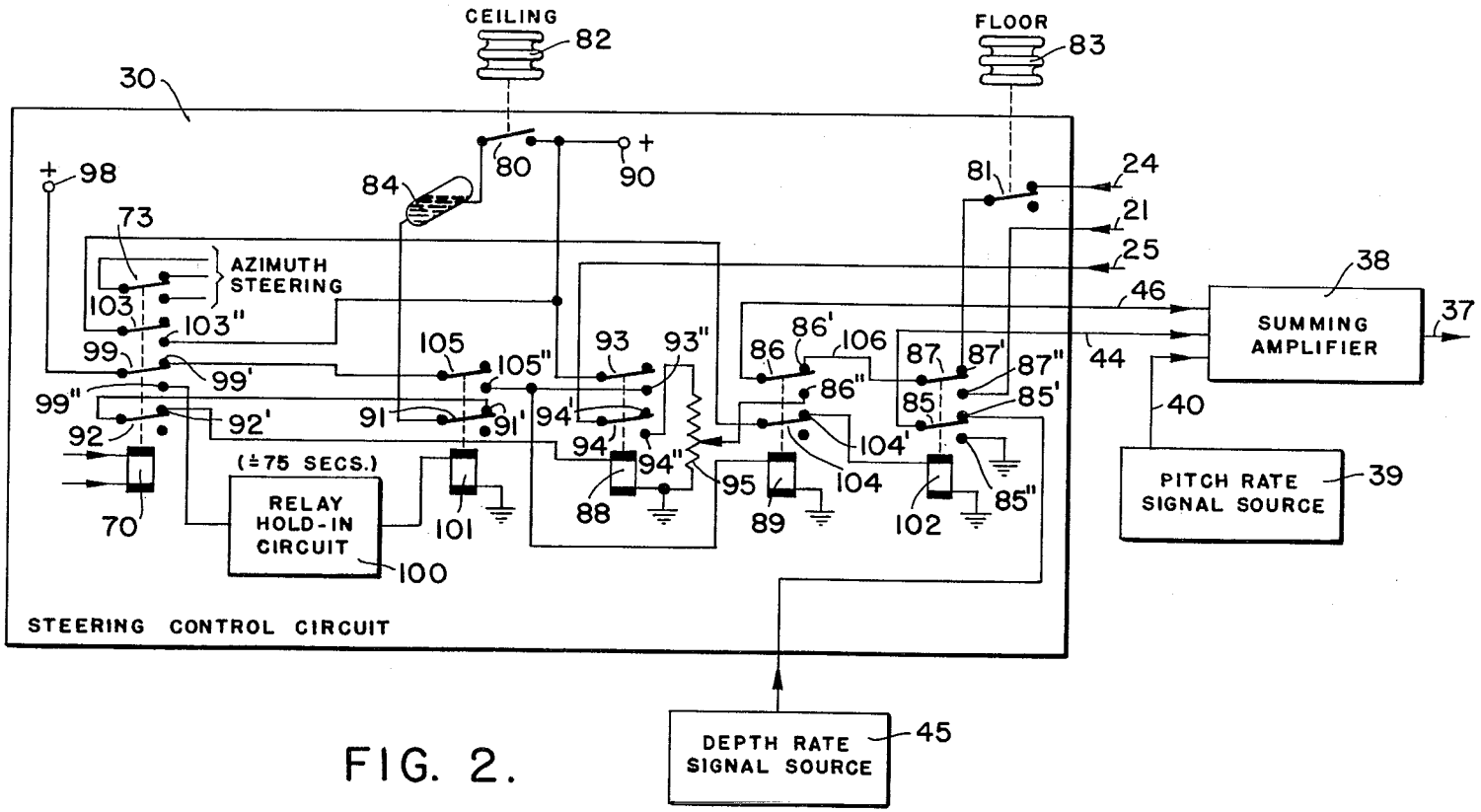

Other objects and many of the attendant advantages of this invention will be readily appreciated as the same becomes better understood by reference to the following detailed description when considered in connection with the accompanying drawing wherein:

FIG. 1 is an exemplary embodiment of the invention in an active-acoustic homing torpedo system shown largely in block diagram form; and FIG. 2 is a schematic, partly in block diagram form, of steering and depth control circuitry and apparatus employed in the FIG. 1 torpedo system.

Except for the steering control circuits and their coaction with associated units to provide flat circle search at target loss depth before reverting to full depth search, and except for the stabilized depth control system, later detailed, the exemplary torpedo system shown largely in block diagram form in FIG. 1 is basically of known type. Each of the block-represented units, except that concerning the steering control circuit (detailed principally in FIG. 2), may be entirely conventional. It should also be understood that for purposes of simplification and sufficing to impart a full understanding of the invention, the torpedo system as illustrated and described is limited to that employed during the search and pursuit phase, and further excludes enabling, snake-search run-out, anti-broach and other circuits and functions which are not material to the present invention.

First considering the general operation of the complete system and referring to FIG. 1, relay 5 is operated by pulser 6 to close the normally open switch 7 (and to open the normally closed switch 8) for brief periods of say 40 milliseconds or less duration, at intervals of say 1.25 seconds. The voltage supplied to terminal 9 is thus intermittently applied to transmitter 10, resulting in the generation and projection of search pulses. Duplexer 15 enables use of the transducer 16 (of conventional multi-sectioned type, not detailed) for both projection of search pulses and reception of resultant echo pulses. Target echoes, which may be received during the listening periods between successive pulses, are converted by the receiver 17 into target direction signals, utilized by steering signal circuits 18 and 19, during the pursuit phase, to provide azimuth steering signals at lead 20 and depth steering signals at lead 21, as will appear. The azimuth steering signal circuit also provides say port and starboard circling signals at leads 22 and 23, respectively; in this particular instance, only the starboard circling signal at lead 23 is employed, during the target search phase. Similarly, the depth steering signal circuit provides dive and climb signals at leads 24 and 25, respectively, for use during the target search phase.

These various signals provided by the azimuth and depth steering signal circuits 18 and 19 are selectively relayed through the steering control circuit 30, in a manner to be described in detail, to the azimuth steering apparatus 31 which operates the torpedo rudder 32 to control direction of torpedo movement in azimuth, and to the depth steering apparatus 33 which operates the torpedo elevators 34 to control direction of torpedo movement in depth, i.e., in a vertical plane. In the illustrated embodiment, the azimuth and depth steering apparatus 31 and 33 are of the type employing a phase-reference voltage provided by a.c. source 35 as indicated, and operating rudder 32 and elevators 34, respectively, in accordance with the in-phase or opposed-phase condition of signals delivered to the azimuth and depth steering apparatus via leads 36 and 37, respectively.

Azimuth steering apparatus 31 may include means providing rudder position and course rate signals for summation with its input signal to limit the turning rate in azimuth to some predetermined maximum value, in accordance with conventional practice.

The input signal applied to depth steering apparatus 33 via lead 37 is a summation of signals supplied to summing amplifier 38, at all times including a pitch rate signal provided by source 39 via lead 40. The particular signal or signals additionally supplied to the summing amplifier 38 depends upon the action of the steering control circuit 30, in turn dependent upon target detection and torpedo conditions, later described in detail. During a search phase, the signals additionally supplied by steering control circuit 30 to summing amplifier 38 are a depth rate signal, via lead 44 and arising from source 45, and a dive or climb signal via lead 46; during a homing phase, it is an up or down steering signal which is additionally supplied, via the same lead 46; during a flat circle search condition, steering control circuit 30 additionally supplies only a depth rate signal to summing amplifier 38, again via lead 44.

An example of circuitry which may be employed in the steering signal circuits, to provide suitable signals for control of the steering apparatus, is illustrated in simplified schematic form in the azimuth steering signal circuit 18. The target direction signals as supplied by receiver 17 via leads 47,48 may take the form of a.c. signals, having brief duration corresponding to that of the received target echoes, and having phase and amplitude characteristics dependent upon the azimuthal angular deviation of target direction relative to the torpedo pointing axis (not shown). In the instance of such type of target direction signals, steering relay tubes 49,50 are employed as phase-sensitive detectors to which receiver 17 also supplies oppositely phased reference signals via the same leads 47,48. With switch 8 of relay 5 in its normally closed condition during a listening period, voltage supplied to terminal 54 is applied to the differential-type steering relay 55, and provided that the cathodes of tubes 49,50 become grounded through switch 56 by action of relay 57 as occurs in response to each reception of a target echo by receiver 17, the azimuth steering signal circuit reacts to the target direction signals applied thereto. Switch arm 58 of the steering control relay 55 accordingly moves into engagement with either contact 58' or 58", dependent upon whether the received echo arrives from say a port or starboard target, respectively. When moved into engagement with either contact 58' or 58", switch arm 58 is maintained in such condition until the end of the listening period, at which time normally closed switch 8 opens and breaks the holding circuit which includes resistor 59, releasing switch arm 58 so that it is always in engagement with the mid-position contact at the beginning of each listening period. Switch arm 60, linked to switch arm 58, correspondingly remains in engagement with its mid-position contact 61 for a straight-ahead target or in the absence of any target echo, or moves into engagement with contact 60' or 60" dependent upon whether a target echo is received and arrives from say a port or starboard target, respectively. Contacts 60', 60" and 61 are associated with transformer 62, reference ground, and the a.c. source 35 as shown. Azimuth steering signal circuit 18 thus supplies to lead 20, during a pursuit phase and in response to reception of a target echo during a listening period, a steering signal of phase dependent upon target direction in azimuth. Oppositely phased a.c. signals are continuously available at leads 22 and 23, of which, in the illustrated embodiment, it is only that at lead 23 which is utilized as a starboard circling signal, during a search phase.

Similarly, depth steering signal circuit 19, by use of the same type of circuitry as in the azimuth steering signal circuit 18, and associated with receiver 17 in like manner, provides up or down steering signals at lead 21, during pursuit action, in accordance with the phase characteristic of the target direction (in depth) signals supplied by receiver 17 via leads 63, 64. Depth steering signal circuit 19 likewise continuously provides dive and climb signals at leads 24 and 25, respectively, for use during the search phase.

Now considering in detail the steering control circuit 30 and its operation, the circuitry therein as illustrated in FIG. 1 is limited to primarily concern the means for effecting switchover from search to pursuit, and for controlling torpedo steering in azimuth during search, and during pursuit. The further circuitry in the steering control circuit 30 as illustrated in FIG. 2 concerns control of torpedo steering in depth, during search and during pursuit. All relays in the steering control circuit 30 are to be understood as shown in FIGS. 1 and 2 in an initially de-energized condition.

Referring first to FIG. 1, gating relay 57 becomes energized by receiver 17 in response to reception of each target echo and only during the brief period of each target echo. Relay 70, which directly effects switchover from search to pursuit circuitry, is not initially energized, but remains energized for a preselected period when the relay hold-in circuit 71 has been triggered by closure of switch 72 as a result of gating relay 57 operation. Thus, prior to first reception of a target echo, that is, during a search phase, gating relay 57 has not been energized, switchover relay 70 is not energized, and switch arm 73 is in engagement with its upper contact 73', connecting lead 23 to lead 36 and thus applying the starboard circling signal to azimuth steering apparatus 31. Under such conditions, the torpedo runs continuously in a starboard circle (until the torpedo enters a pursuit phase and switchover relay 70 operates to cut off application of the circling signal). The starboard circling function is employed alone during flat circle search, and with torpedo climb action during helical search, as will appear.

When energized by receiver 17 during reception of a target echo, gating relay 57 briefly closes switch 56, resulting in making available at lead 20 an azimuth steering signal (also a depth steering signal at lead 21), as already described, for the remainder of that listening period in which the target echo has occurred. Successive target echoes result in successive azimuth (and depth) steering signals. Gating relay 57 also briefly closes switch 72, triggering the relay hold-in circuit 71 which operates to energize switchover relay 70 and to maintain it in energized condition for a preselected period of say about 4 seconds (accommodating three listening periods in the described embodiment) as measured from each triggering instant; following initial operation of gating relay 57, switchover relay 70 thus remains cntinuously energized until the end of say three listening periods in which no target echo has been received. Switch arm 73, now in continuous engagement with its lower contact 73" by hold-in energization of switchover relay 70, connects lead 20 to lead 36, applies azimuth steering signals to azimuth steering apparatus 31, and the torpedo accordingly homes in azimuth toward the target. Reception of the first of a series of target echoes thus effects a target acquisition condition and initiates a target pursuit phase. In the event of target echo loss and upon expiration of the preselected (say 4-second) target-loss period, the system switches to a search phase in which the torpedo initially executes flat circle search, as will be detailed.

Referring now to FIG. 2 concerning additional circuitry which controls torpedo steering in depth, and first considering its operation during a search phase, the torpedo (while circling in azimuth as has been described) alternately dives and climbs between preselected search ceiling and search floor depths which are in effect recognized by ceiling and floor switches 80 and 81, respectively, operated by depth responsive elements 82 and 83, respectively. Mercury switch 84 operates to remain closed unless the torpedo pitches more than say 3° downward from level attitude; the system may be designed to effect diving action in the search phase at an angle very considerably greater than 3° downward, and climbing action at an angle of say about 4° upward. The dive and climb actions are stabilized by application of a depth rate signal to summing amplifier 38, via lead 44, switch arm 85 and its upper contact 85', from depth rate signal source 45. First assuming the torpedo to be in dive operation, all relays are de-energized as indicated; the dive signal is applied to summing amplifier 38 via lead 46, switch arm 86 and its upper contact 86', switch arm 87 and its upper contact 87', normally closed switch 81, and lead 24 at which the dive signal is continuously available as described. When the torpedo penetrates the search floor, switch 81 opens and breaks the dive signal circuit to summing amplifier 38. The torpedo accordingly levels off (somewhat below search floor depth) and mercury switch 84 closes, initiating torpedo climb action. The latter action takes place as a result of energization of relays 88 and 89; voltage supplied to terminal 90 is applied to relay 88 via normally closed ceiling switch 80, mercury switch 84, switch arm 91 and its upper contact 91', and switch arm 92 and its upper contact 92'; this voltage is also applied to relay 89 via switch arm 93 and its lower contact 93'' which it engages because of relay 88 energization. Since relays 88 and 89 are energized, the climb signal cintinuously available at lead 25 is applied to summing amplifier 38 via switch arm 94 and its lower contact 94'', the voltage-reducing potentiometer 95, switch arm 86 and its lower contact 86'', and lead 46. When the torpedo soon again penetrates the search floor, from below, floor switch 81 again closes, but the dive signal circuit to summing amplifier 38 nevertheless remains broken, and application of the climb signal continues, because energization of relay 89 has moved switch arm 86 from contact 86' to contact 86''. When the torpedo reaches and penetrates the search ceiling, switch 80 opens, causing de-energization of relays 88 and 89. The torpedo consequently then reverts to the dive operation, by application of the dive signal through closed floor switch 81 as already described, and, pitching downward, opens mercury switch 84 and thus maintains de-energization of relays 88 and 89 despite the closing of ceiling switch 80 when the torpedo soon again penetrates the search ceiling, from above.

The circling, dive and climb characteristics provided during the search phase, as above described, combine to effect fast transport of the torpedo from the search ceiling to the search floor, and upward helical search action from the search floor to the search ceiling, in a repetitive sequence.

Next considering operation of the steering control circuit 30 as to depth control during the pursuit phase, initiated as a result of target acquisition as has been described, the continuous energization of switchover relay 70 effects application of successive depth steering signals to summing amplifier 38. In greater detail, with switchover relay 70 in energized condition, the voltage supplied to terminal 98 is applied via switch arm 99 and its lower contact 99'' to relay hold-in circuit 100, which operates to energize relay 101 and to maintain it energized for a period of preselected duration which becomes of importance when the torpedo reverts to a renewed search phase as will appear. Relays 88 and 89 remain de-energized during the pursuit phase. Relay 102 is energized by the voltage supplied to terminal 90, via engagement of switch arm 103 and its lower contact 103'', and switch arm 104 and its upper contact 104'. Depth steering signals are thus applied from lead 21, via engagement of switch arm 87 and its lower contact 87'', switch arm 86 and its upper contact 86', and lead 46, to summing amplifier 38. As previously mentioned, only the pitch rate signal is additionally applied to summing amplifier 38 during this pursuit phase, relay 102 energization having disconnected the depth rate signal source by moving switch arm 85 from upper contact 85' to lower contact 85''. The torpedo accordingly homes in depth (and in azimuth as previously described) toward the target.

Finally considering operation of steering control circuit 30 as to renewed search action in the event of target echo loss for say three successive listening periods, switchover relay 70 becomes de-energized (and effects circling in azimuth as has been described), and the continued energization of relay 101 (through action of relay hold-in circuit 100) prevents application of dive and climb signals to summing amplifier lead 46 during a preselected period, say about 75 seconds in a typical instance, sufficient to accommodate at least a complete azimuth circling turn of the torpedo. The torpedo thus executes flat circle search until expiration of the preselected period, at which time dive and climb signals also are again applied to summing amplifier 38, re-establishing full search in depth. In greater detail, with switchover relay 70 de-energized as a result of target loss, but with relay 101 remaining energized during the preselected flat-circle search period, relay 88 remains de-energized for a like period, and climb signals available at lead 25 therefore terminate at switch arm 94 which is in engagement with its unused upper contact 94'. Relay 89 is energized via engagement switch arm 105 and its lower contact 105'', and switch arm 99 and its upper contact 99', by the voltage supplied to terminal 98. Energization of relay 89 holds switch arm 86 out of engagement with its upper contact 86', from which dive signals are otherwise available via lead 24, closed switch 81, upper contact 87' engaged by switch arm 87, and lead 106. Energization of relay 89 also holds switch arm 104 out of engagement with its upper contact 104', insuring that relay 102 remains in de-energized condition, with its switch arm 85 engaging its upper contact 85', and thus applying a depth rate signal from source 45 to summing amplifier lead 44 in addition to the pitch rate signal continuously applied from source 39 to summing amplifier lead 40. During energization of relay 101, therefore, neither dive nor climb signals are applied to lead 46 of summing amplifier 38, and the torpedo runs stably in flat circle condition at a substantially constant depth as provided by use of depth rate and pitch rate signals to control the depth steering apparatus. Upon expiration of the preselected flat circle search period, relay 101 becomes de-energized and the steering control circuit thus reverts to full search control in both azimuth and depth, effecting a repetitive sequence of upward helical search action to the search ceiling and fast transport to the search floor as already described. Reception of a target echo at any time during a renewed search phase results in energization of switchover relay 70 and re-entry into a pursuit phase.

It will not be apparent that the present invention provides an improved homing torpedo system which, upon target loss, switches the torpedo to a search phase wherein the torpedo is maintained, for a predetermined period, in circle search at substantially the most likely depth from which to reacquire a target submarine, and also provides a practical and effective depth control system for stably maintaining the torpedo substantially at a given depth level.

Various modifications of the particular embodiment described will occur to those skilled in the art. For example, for receiving and converting the target echoes to target direction signals, and for deriving steering information or steering signals therefrom, other techniques than those described herein may be employed. As another example, while the described embodiment of the improved homing torpedo system preferably includes pitch rate and depth rate sensors in particular for control of the depth steering apparatus to stably maintain a substantially constant depth during flat circle search, an inherently less effective pitch angle sensor (equivalent only under steady state conditions) may be utilized in place of the depth rate sensor.

Obviously many modifications and variations of the present invention are thus possible in the light of the above teachings. It is therefore to be understood that within the scope of the appended claims the invention may be practiced otherwise than as specifically described.

What is claimed is:

1. In a homing torpedo, in combination: means for providing a target search phase of torpedo operation wherein said torpedo is controlled to change depth between predetermined search floor and search ceiling depths and simultaneously controlled to circle in azimuth, whereby to execute helical search action; means for switching, in response to target acquisition at any time during a search phase of torpedo operation, to a target pursuit phase of torpedo operation; and means for switching, in the event of and in response to target loss continuing for a predetermined period in a target pursuit phase, to a modified search phase of torpedo operation wherein said torpedo is initially controlled to execute circle search action while maintaining depth position at substantially that at which target loss occurred, for a predetermined period accommodating at least a complete azimuth circling turn, then controlled to revert to helical search action.

2. In a propulsive torpedo having depth-steering elevators, in combination, a depth control system comprising means for deriving a first signal having characteristics corresponding to the sense and magnitude of rate of change of torpedo depth, means for deriving a second signal having characteristics corresponding to the sense and magnitude of rate of change of torpedo pitch angle, means for combining only said first and second signals to provide a summation error signal, and depth-steering elevator control apparatus responsive only to said error signal to effect reduction of torpedo pitch angle rate and depth rate to substantially zero values, whereby to maintain said torpedo at substantially constant depth.

* * * * *